US006065712A

United States Patent [19]

Mayer et al.

[11] Patent Number: 6,065,712

[45] Date of Patent: May 23, 2000

[54] METHOD AND APPARATUS FOR WINDING A YARN INTO A PACKAGE

[75] Inventors: Manfred Mayer, Remscheid; Friedhelm Lenz, Wuppertal, both of Germany

[73] Assignee: Barmag AG, Remscheid, Germany

[21] Appl. No.: 09/031,215

[22] Filed: Feb. 26, 1998

[30] Foreign Application Priority Data

Feb. 27, 1997 [DE] Germany ..... 197 07 875
Mar. 6, 1997 [DE] Germany ..... 197 09 018

[51] Int. Cl.[7] ..... B65H 54/28; B65H 54/38

[52] U.S. Cl. ..... 242/477.2; 242/477.3; 242/477.5; 242/477.9; 242/480.4

[58] Field of Search ..... 242/477.1, 477.2, 242/477.3, 477.5, 477.9, 480.4, 481.4, 481.6

[56] References Cited

U.S. PATENT DOCUMENTS

| | | | |
|---|---|---|---|
| 3,352,505 | 11/1967 | Parker | 242/477.3 |
| 3,606,197 | 9/1971 | Akers | 242/477.5 X |
| 4,280,667 | 7/1981 | Akers | 242/477.1 |
| 4,349,160 | 9/1982 | Niederer | 242/477.1 |
| 4,544,113 | 10/1985 | Yoshinaga et al. | 242/477.2 X |
| 4,659,027 | 4/1987 | Schippers et al. . | |
| 4,767,071 | 8/1988 | Hirai | 242/477.2 |
| 4,771,960 | 9/1988 | Yamamoto et al. | 242/477.2 |
| 4,911,370 | 3/1990 | Schippers et al. | 242/477.5 |
| 4,913,363 | 4/1990 | Lenz | 242/477.2 |
| 4,928,896 | 5/1990 | Symon | 242/481.6 |
| 4,948,057 | 8/1990 | Greis | 242/481.4 X |
| 5,112,001 | 5/1992 | Yamamoto et al. | 242/477.2 |

FOREIGN PATENT DOCUMENTS

| | | |
|---|---|---|
| 0 235 557 | 3/1990 | European Pat. Off. . |
| 0 453 622 | 2/1995 | European Pat. Off. . |

*Primary Examiner*—Michael R. Mansen
*Attorney, Agent, or Firm*—Alston & Bird LLP

[57] ABSTRACT

A method and apparatus for winding a continuously advancing yarn, wherein the yarn is wound into a package that is formed on a tubular core, the yarn being traversed by a yarn guide within a traverse stroke. At the beginning of each traverse stroke, the yarn guide is accelerated within a reversal length to a guiding speed, and after traversing the traverse length it is decelerated within a second reversal length. The acceleration and/or deceleration of the yarn guide are controllable, so as to modify the yarn deposit in the package edges.

21 Claims, 9 Drawing Sheets

METHOD AND APPARATUS FOR WINDING A YARN INTO A PACKAGE

BACKGROUND OF THE INVENTION

The present invention relates to a method and apparatus for winding a continuously advancing yarn into a package.

When winding a yarn into a package, it is always attempted to obtain a stable package build, a uniform packing density, as well as satisfactory unwinding characteristics during a later further processing stage. In this connection, the end faces of such packages may extend in a normal plane, so that cylindrical packages are obtained, or they may be inclined relative to this normal plane, so that a biconical package is formed. In the winding of packages, the problem arises that the yarn reversal causes a mass accumulation at the package edges, which leads to hard package edges or a bulgy package edge.

It is known both from U.S. Pat. No. 4,659,027 and from EP 0 235 557 that for purposes of avoiding the bulges at the package ends, the traverse stroke may be changed by modifying the stroke, i.e., by periodically shortening and lengthening the traverse stroke in the end region of the package edges, thereby displacing the reversal point at the package edge. However, the yarn deposit in each of the reversal points is the same, so that the yarns are distributed at the package ends as a function of the stroke modification frequency. This procedure has shown that at a small stroke modification frequency the end faces of the package are softer in comparison with a package that is wound at a high stroke modification frequency.

In an effort of avoiding excessively high package edges, a further disadvantage is found in that the traverse stroke must be shortened by as much as 20 mm during the stroke modification. While this shortening prevents a buildup of edges, the yarn is deposited irregularly and, thus, an irregular packing density is incurred in the edge region, which leads likewise to soft end faces of the package. Depending on the kind of further processing, this is undesirable, since soft packages are more susceptible to damage than hard packages.

Furthermore, the alternate shortening or lengthening of the traverse stroke has the disadvantage that the yarn guide reciprocating the yarn is urged to cover alternatingly a long and a short traverse distance.

It is accordingly an object of the present invention to provide a method and apparatus for winding an advancing yarn into a package, which corrects the yarn deposit in the edge region irrespective of a stroke modification and irrespective of the length of the traverse stroke.

SUMMARY OF THE INVENTION

The above and other objects and advantages of the present invention are achieved by the provision of a yarn winding method and apparatus which include guiding the advancing yarn onto a rotating core by a traversing yarn guide which moves within a traverse stroke. Also, during each traverse stroke the traversing yarn guide is accelerated by a predetermined acceleration to a guiding speed within a reversal length at one end of the traverse stroke, and decelerated from the guiding speed by a predetermined deceleration within a second reversal length at the opposite end of the traverse stroke. At least one of the acceleration and the deceleration is controlled during each traverse stroke so that the deposit of the yarn onto the package can be varied at at least one of the package ends. Preferably, both the acceleration and deceleration are controlled so that the yarn deposit can be separately varied at each of the package ends.

The invention will be seen to be distinct from EP 0 453 622 which discloses a method in which the position of the yarn guide is dependent on the position of the rotor of an electric motor. The known method describes a solution to operating an apparatus, which facilitates movement of the yarn guide in the reversal region at very high accelerations and decelerations. In this apparatus, the movement of the electric motor is controlled by means of a control unit as a function of normal laws of winding, thus giving rise to the aforesaid problems with the package edges.

While being traversed, the yarn is deposited by a speed function of the traversing yarn guide. This speed function is characterized by three stages. Initially, it is necessary to accelerate the yarn guide from the reversal point to a guiding speed. The distance, which it covered by the yarn until is reaches the desired guiding speed, is defined as the reversal length. Subsequently, the yarn is moved at the guiding speed until it reaches the opposite end of the traverse stroke, with the covered distance being described herein as the linear length. At the opposite end, the yarn guide is decelerated from the guiding speed such that its speed is zero at the reversal point. The distance covered during the deceleration phase is likewise referred to as the reversal length. Thus, the traverse stroke as defined by the reversal points results from adding these three partial lengths. The reversal length of the yarn guide is determined substantially by the adjusted acceleration or deceleration of the yarn guide. The method of the present invention now uses in particular the acceleration or deceleration of the yarn guide, so as to influence the deposit of the yarn. To this end, the accelerations and decelerations may be controlled so as to change the extent of the reversal length, thus initiating the start of the yarn reversal at an earlier or later point toward the end of the traverse stroke. As a result, the yarn is deposited at different angles toward the end face of the package, thus facilitating a uniform distribution of the yarn directly after the reversal point.

The reversal function of the acceleration and deceleration may be determined by a microprocessor, such that it is possible to realize any desired reversal functions of the yarn guide. It is also possible, however, to move the yarn guide by a stepping motor.

The reversal function may be made symmetric, so that deceleration and acceleration of the yarn guide are identical. This realization is suitable in particular for making the yarn deposit uniform in the edge region.

It is also possible to predetermine an asymmetric reversal function. Such a control is advantageous to prevent yarn from sloughing off at the package end. To this end, the yarn is guided with a slight deceleration toward the package end and, thereafter, moved away therefrom at a very high acceleration. The change of the reversal length makes it possible to realize, without additional measures, an acceptable package build with relatively flat edges and straight end faces or smooth slope surfaces.

In the above cases, the control of the deceleration and acceleration of the yarn guide may be effected by a predetermined chronological program sequence. This allows any desired time function to be realized. Thus, while breaking a ribbon, it would be possible to follow the change of the reversal length proportionately after switching to a higher traversing speed.

In a further, advantageous modification, the deceleration and/or acceleration of the yarn guide are controlled as a function of the guiding speed. Thus, it becomes possible to produce within a double stroke a different yarn deposit in each single stroke. Furthermore, it is possible to realize an advantageous interconnection with a ribbon breaking method. A ribbon is described as a phenomenon of the package, in which undirected yarn lengths come to lie more or less exactly on top of one another in successively wound layers of the yarn. Normally, the symptoms of such ribbons are avoided by constantly decreasing or increasing, for example, between an upper and a lower limit, the guiding or traversing speed, which is expressed as number of reciprocal movements (double strokes) of the traversing yarn guide per unit time. The cooperation of change in the reversal length and a ribbon breaking makes it possible to realize a further improved binding of the yarn layers in the edge region of the package. In this connection, it is also possible to change the reversal length by wobbling the deceleration or acceleration of the yarn guide.

A further variant of the method of the invention permits the acceleration or the deceleration to be maintained constant in the reversal region during the changes in the guiding speed.

In accordance with the invention, the extent of the reversal length may be decreased at low guiding speeds of the yarn guide. As a result, it is possible to realize more precise yarn deposits in the reversal region, which distinguish themselves by a better binding of the yarn layers, lesser displacements of the deposited yarn layers, as well as prevention of slipping yarn layers.

A further, preferred embodiment of the invention makes is possible to adapt the yarn layers in the reversal region to a respectively adjusted crossing angle. This avoids having the yarn layers slip in the reversal region.

The speed of the yarn guide within the traverse stroke may be controlled. This is especially suited for influencing the package build within a linear length of the traverse stroke, wherein the crossing angle is constant. However, an increase of the guiding speed in the linear length would lead automatically, without changing deceleration, to an increase in the reversal length. With that, it is also possible to change the extent of the reversal length alone by controlling the guiding speed.

In a further preferred variant of the invention, the extent of the reversal length is changed as a function of the traverse stroke. This allows the build of high edges to be avoided even in the case of adjustments with slow accelerations and decelerations. This variant permits any kind of stroke modification in combination for purposes of changing the reversal length. In particular, it is preferred to link a shortened traverse stroke with a long reversal length, so that a greater amount of yarn can be deposited. As a result, it is possible to realize a steady decrease in diameter toward the end of the winding tube, which improves the unwinding behavior of the package. A further advantage lies in that it is possible to compensate largely for a change in the yarn tension that is caused by the stroke modification. When winding a package, it matters in particular that a uniform tension be present over the yarn length and over the length of the package, which allows the unwinding characteristics of the package to also be improved.

The method of the present invention may provide that the traverse stroke has a constant length which is smaller than the wound length of the package, and with the ends of the traverse stroke being alternatively displaced flush with the package ends. Thus, the yarn quantity may be uniformly distributed in the region of the package ends without changing the traverse stroke. By this step, the yarn is reciprocated uniformly within each traverse stroke. Thus, the traversing speed is independent of the displacement of the traverse stroke. Furthermore, a uniform yarn tension is attained while the package is being wound.

The method of the present invention may be applied with advantage to cylindrical, cross-wound packages with straight end faces and to such having oblique end faces in their axial section (biconical packages). When winding biconical packages, the modified stroke that is carried out at the package ends becomes shorter as the package diameter increases.

Likewise, it is possible to use the method of the present invention for any kind of wind, such as, for example, random wind, precision wind, stepped precision wind, etc.

The extent by which the ends of the traverse stroke can be displaced in the region of the package ends is dependent on the wound length of the package and length of the traverse stroke.

To realize a very even distribution of the yarn quantity at the package ends, it will be of advantage, when the ends of the traverse stroke are displaced within the modified stroke, which is equal to the difference between the wound length of the package and the length of the traverse stroke. The end of the traverse stroke may thus assume any desired position within the modified stroke at the package end.

It is known from practice that a modified stroke of a range from 10 mm to 20 mm at each package end will suffice to obtain a favorable package build. Accordingly, at a package length of 250 mm, a traverse stroke would have to be selected from a length of 190 to 230 mm.

An especially advantageous modification of the method provides that the displacement of the traverse stroke occurs by any predetermined stroke modification function. In this process, the stroke modification function predetermines the change in position of the ends of the traverse stroke within the modified stroke. This facilitates optimization of the package build, in particular with respect to the unwinding behavior. For example, it will be possible to wind one end of the package with flattened edges.

The stroke modification function may in this instance predetermine the change between two adjacent positions of the traverse stroke. Thus, it is possible to predetermine the number of traverse strokes which are to be traversed within one position of the traverse stroke, until the traverse stroke is displaced. In this manner, the package is built up on differently wound layers.

Moreover, the stroke modification function may predetermine the change in position of the traverse stroke within the modified stroke as a function of time. This allows the yarn quantity to be distributed with advantage over the entire modified stroke.

A further embodiment of the invention provides for displacement of the traverse stroke by a predetermined time program. As a result, a further parameter is made available for influencing the build of the package.

To influence the yarn deposit at the package ends in different ways, it will be of advantage, when the displacement of the traverse stroke is coupled with a shortening and lengthening of the traverse stroke, which results in a significant improvement of the unwinding behavior of the package. In systematic examinations with respect to the unwinding behavior of packages, it was found that a flattening of the cylindrical surface region of the package on the side facing away from the unwinding side of the yarn brings about a significant improvement of the unwinding characteristics of the yarn.

In a further advantageous modification, the displacement of the traverse stroke is coupled with a traverse breaking method for purposes of avoiding ribbons. A ribbon is a phenomenon of the package, in which equidirectional yarn lengths overlie one another more or less exactly in successively wound layers of the yarn. Normally, the symptoms of such ribbons are avoided by constantly decreasing or increasing, for example, between an upper and a lower limit, the traversing speed which is expressed as number of reciprocal movements (double strokes) of the traversing yarn guide per unit time. The cooperation of displacement of the traverse stroke and a traverse breaking makes it possible to realize a further improved binding of the yarn layers in the edge region of the package.

BRIEF DESCRIPTION OF THE DRAWINGS

Some of the objects and advantages of the invention having been stated, others will become apparent as the description proceeds, when considered in conjunction with the accompanying drawings, in which.

DETAILED DESCRIPTION OF THE PREFERRED EMBODIMENTS

Figure 1:
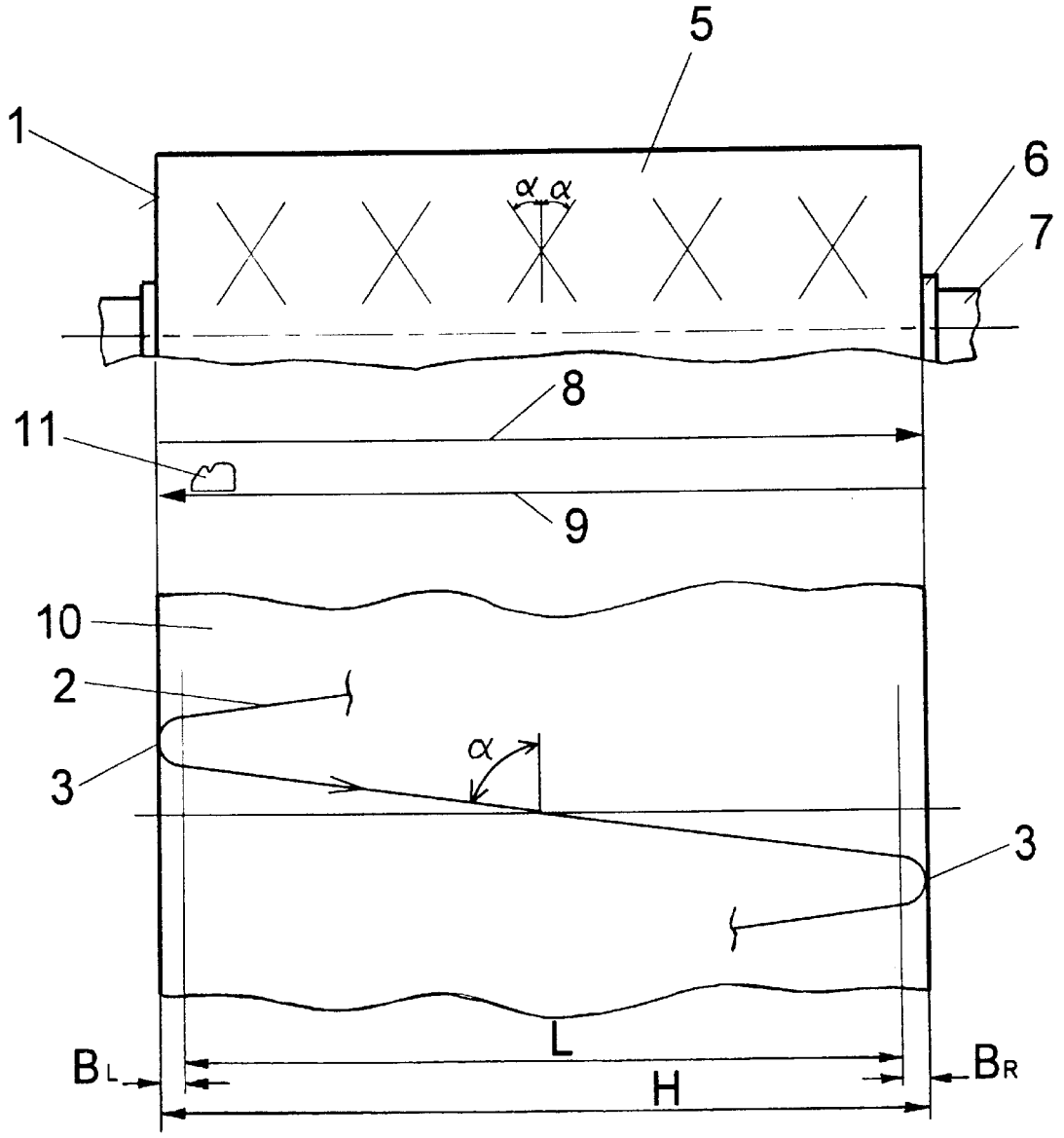
FIG. 1 illustrates a yarn deposit on a package during a traverse stroke.

FIG. 1 shows a yarn deposit on a package during a traverse stroke. Shown in the upper half of the Figure is a package 5. The package 5 is wound on a tube or core 6. To this end, the core 6 is inserted on a winding spindle 7. The package is a cylindrical package 5 with end faces 1 that is wound at a constant angle of crossing $\alpha$. However, the package 5 may also have a biconical shape or any desired shape. The package 5 may also be wound in any desired kind of wind, such as, for example, random wind, precision wind, or stepped precision wind, as well as combinations thereof. To deposit a yarn on a package, the package 5 may be rotatably driven by a friction roll (not shown) or directly by the winding spindle 7. Before being deposited on the package, the advancing yarn is guided by a yarn guide 11 in direction of movement 8 from the left package end to the right package end, and in direction of movement 9 from the right package end to the left package end. This sequence of movements is called a double stroke of the traversing yarn guide 11.

The yarn guide may be driven, for example, by a linear drive or a belt drive. In this instance, the linear drive or the belt drive is connected, for example, to a stepping motor. The movement of the yarn guide may then be precisely controlled via a programmable control device.

The lower half of FIG. 1 shows on package surface 10 a yarn layer 2 which is wound during a traverse stroke. The traverse stroke H, which is equal to the wound length of the package, is bounded at each end by a reversal point 3. The reversal point 3 is the position, in which the yarn guide has no speed. Starting with the traverse stroke on the left side of the package in FIG. 1, the yarn is initially displaced within a reversal length $B_L$ at a steadily increasing crossing angle. As soon as the yarn guide is accelerated to the guiding speed, which is predetermined for displacing the yarn on the package surface, the yarn is deposited at a constant angle of crossing $\alpha$. In the Figure, this distance is indicated as linear length L. At the right end of the package, the yarn guide is decelerated such that it has again a zero speed in reversal point 3. Therefore, in reversal region $B_R$, the yarn is displaced at a steadily decreasing crossing angle $\alpha$. With that, it becomes clear that the package edges formed at the ends of the traverse stroke depend substantially on the yarn deposit in the reversal region. The reversal length $B_L$ or $B_R$ is defined exclusively by the acceleration or deceleration of the yarn guide. Thus, a high acceleration or deceleration of the yarn guide leads to a short reversal length in the reversal region. However, a small reversal region causes a relatively massive accumulation of yarn in the region of the reversal point. A low acceleration or deceleration increases the reversal length, which results in a changed yarn deposit on the edges of the package.

Figure 2B:
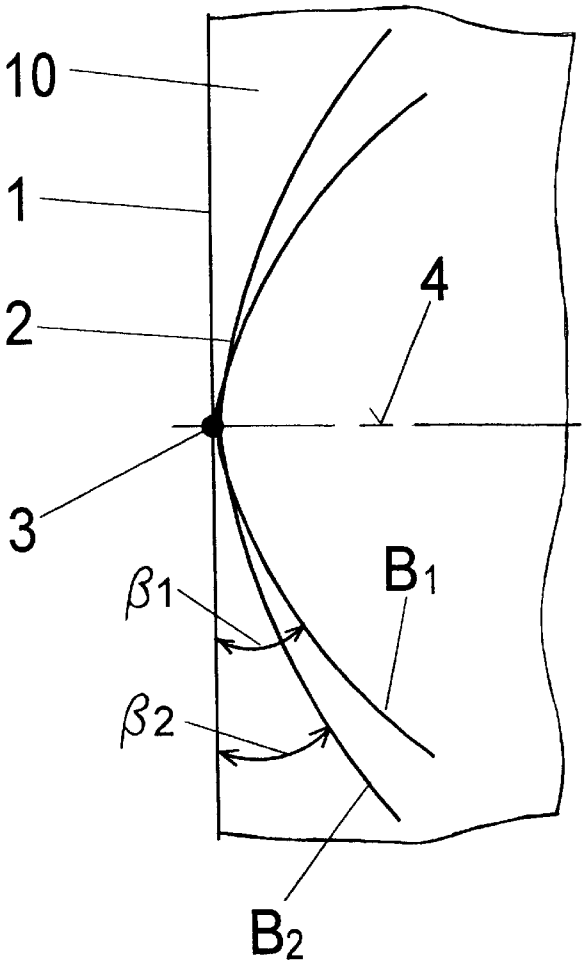
FIGS. 2*a* and 2*b* each illustrate a yarn deposit on the package surface in the reversal region.
Figure 2A:
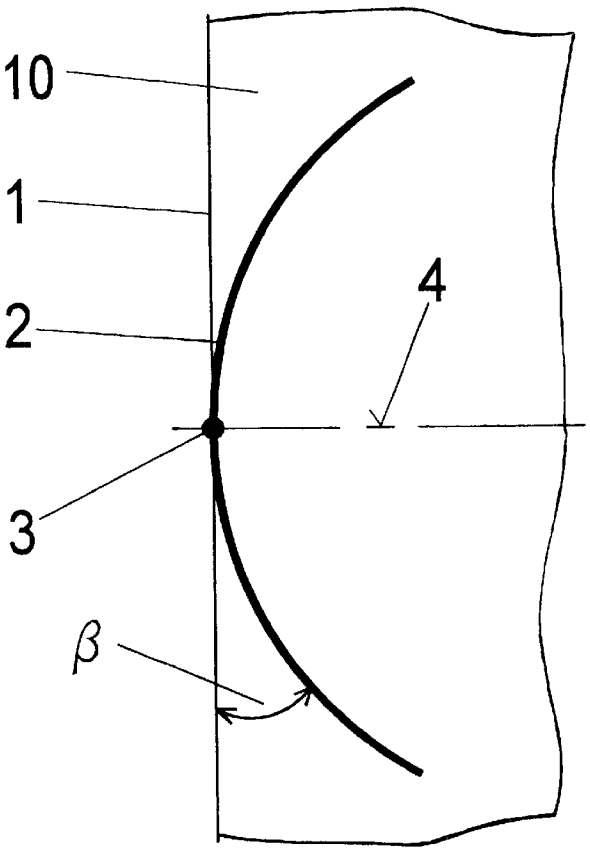

FIGS. 2*a* and 2*b* show the situation of the yarn deposited on the package edges in the case of two overlying yarn layers. In FIG. 2*a*, the yarn is traversed at a constant acceleration or deceleration in the reversal regions. The yarn layers 2 lie exactly on top of one another. Between the end face 1 of the package and the yarn layer 2 deposited on package surface 10 an angle $\beta$ forms by approximation, which is identical for both yarn layers.

Contrary thereto, FIG. 2*b* shows the situation, in which the yarn layers 2 are deposited in the reversal region at different accelerations or decelerations. The yarn layer 2 which is displaced at high acceleration or deceleration in the reversal region is indicated at $B_1$ in FIG. 2*b*. The yarn layer 2 which is displaced at a lesser acceleration or deceleration and, thus, over a great reversal length, is indicated at $B_2$. The yarn layer $B_1$ forms with end face 1 a larger angle of approximation $\beta_1$ than yarn layer $B_2$. As a result, the yarn deposit is corrected in the reversal region. By repeatedly changing acceleration or deceleration, it is possible to produce with advantage very acceptable interlacings of the yarn layer in the edge regions of the package. Thus, it is possible to avoid with advantage sloughing layers when unwinding the package, and to wind packages with hard end faces.

Figure 3:
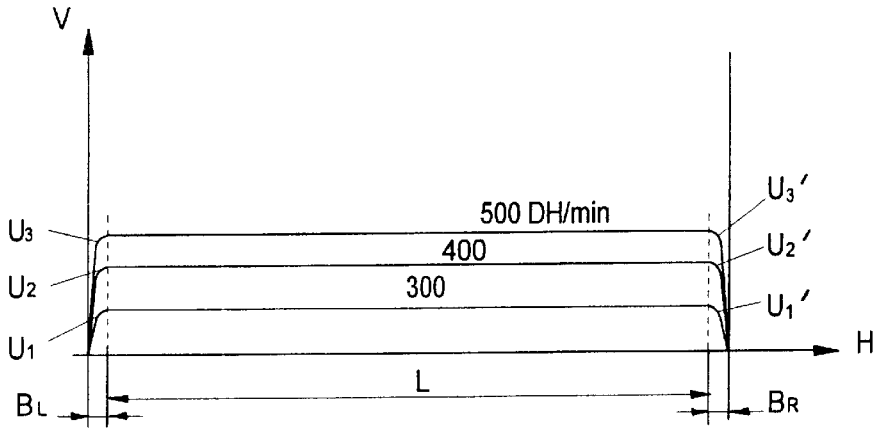
FIG. 3 is a diagram of the yarn guide speed as a function of the traverse stroke at different double stroke rates.

FIG. 3 is a diagram showing the basic correlation between the speed of the traversing yarn guide and the traverse stroke. The traverse stroke H is formed by partial lengths $B_L$, L, and $B_R$. The reversal length at the left edge of the traverse stroke is indicated in the diagram at $B_L$, and the reversal length at the right edge of the traverse stroke at $B_R$. Both traverse lengths are identical. Starting now at the zero point of the diagram, the yarn guide is first accelerated. This acceleration occurs by a reversal function, which is of any desired shape, for example, circular, parabolic, hyperbolic, etc. After reaching a predetermined guiding speed, the acceleration phase of the yarn guide is completed. This point is identified by the transition from the reversal length $B_1$ to the linear length L. Within the linear length L, the speed of the yarn guide is constant. To reverse the movement of the yarn guide at the opposite end, the yarn guide is decelerated within reversal length $B_R$. The deceleration of the yarn guide proceeds again by a reversal function, which may be any desired function. Once the yarn guide reaches zero velocity, the entire sequence is repeated.

FIG. 3 illustrates three curve shapes of different guiding speeds. To identify the guiding speed, the numbers of double strokes of the traversing yarn guide are shown per minute. They are values of 300, 400, 500 double strokes per minute, which are commonly adjusted in practice. To maintain reversal length $B_1$ constant at any of the guiding speeds, the yarn guide is accelerated and decelerated at 300 double strokes per minute by a reversal function $U_1$, at 400 double strokes per minute by a reversal function $U_2$, and at 500 double strokes per minute by a reversal function $U_3$and $U_3'$. This means that to accelerate or decelerate the yarn guide at 500 double strokes per minute in the reversal length $B_1$ or $B_R$ it is necessary to adjust a substantially higher acceleration or deceleration in comparison with the curve at 300 double strokes per minute. Therefore, the method of the present invention could also be used to maintain the extent of the reversal length constant in the reversal regions irrespective of the traversing speed.

Figure 4:
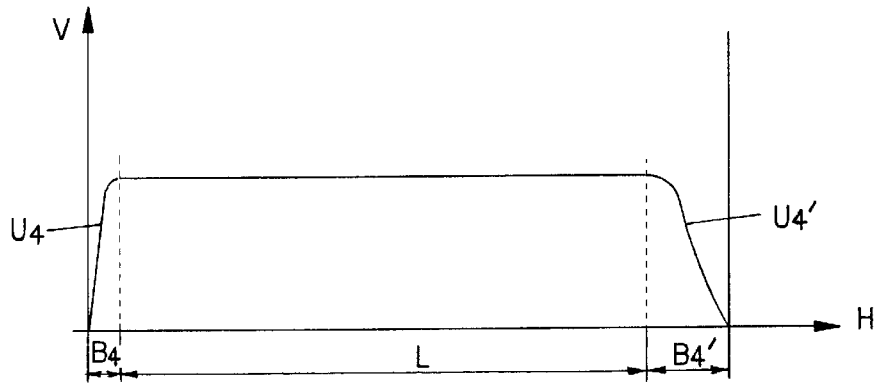
FIG. 4 is a diagram of the yarn guide speed with an asymmetric reversal function.

However, the essential advantage of the method in accordance with the invention consists in influencing the extent of the reversal length and, thus, the yarn deposit in the edge region of the packages. With reference to a speed function of the yarn guide, FIG. 4 illustrates a variant of the method, wherein the acceleration and the deceleration of the yarn guide proceed by different functions. The acceleration of the yarn occurs by reversal function $U_4$. Same is characterized in that it effects a steep rise of the speed. Thus, the yarn is displaced toward the package end within a short reversal length. As previously described with reference to FIG. 2*b*, this will cause the yarn layer to remove itself very fast from the end face 1.

The deceleration of the yarn guide occurs by a reversal function $U_4'$. The reversal function $U_4'$ is characterized in that it shows a moderate drop of the speed toward the reversal point. Thus, in FIG. 4 the resultant reversal length $B_4'$ is greater than reversal length $B_4$. Consequently, the entire reversal region is traversed by an asymmetric reversal function $U_4+U_4'$. As a result of reversal function $U_4'$, it is realized that the yarn guide approaches the package end slowly. This modification of the method is especially suited for avoiding sloughs at the package end.

Figure 5:
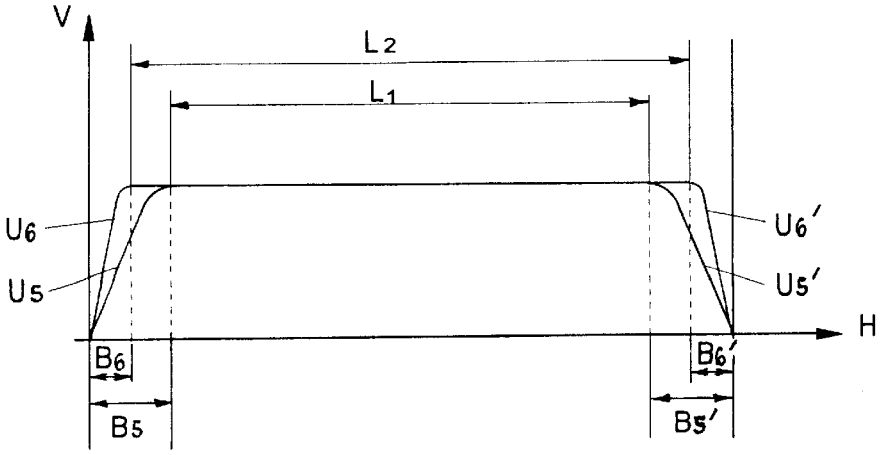
FIG. 5 is a diagram of the yarn guide speed with a variable reversal length.

FIG. 5 illustrates a further modification of the method in accordance with the invention. In this instance, the reversal region is traversed by a symmetric reversal function. Both the acceleration and the deceleration proceed by the same reversal function. However, the traverse strokes are covered by a reversal function $U_5$ or a reversal function $U_6$. The reversal function $U_5$ leads to a moderate rise of the speed within a reversal length $B_5$. After the yarn guide has traversed length $L_1$, it is decelerated by the same reversal function $U_5'$ in reverse length $B_5'$. The second alternative of covering the traverse stroke is shown by lengths $B_6$, $L_2$, and $B_6$. In this instance, the yarn guide is accelerated and decelerated in the reversal regions by reversal functions $U_6$ and $U_6'$. As previously described with reference to FIG. 2*b*, the change between two alternatives permits the yarn deposit to be varied at the package edges. The change may occur by any desired predetermined time program.

Figure 6:
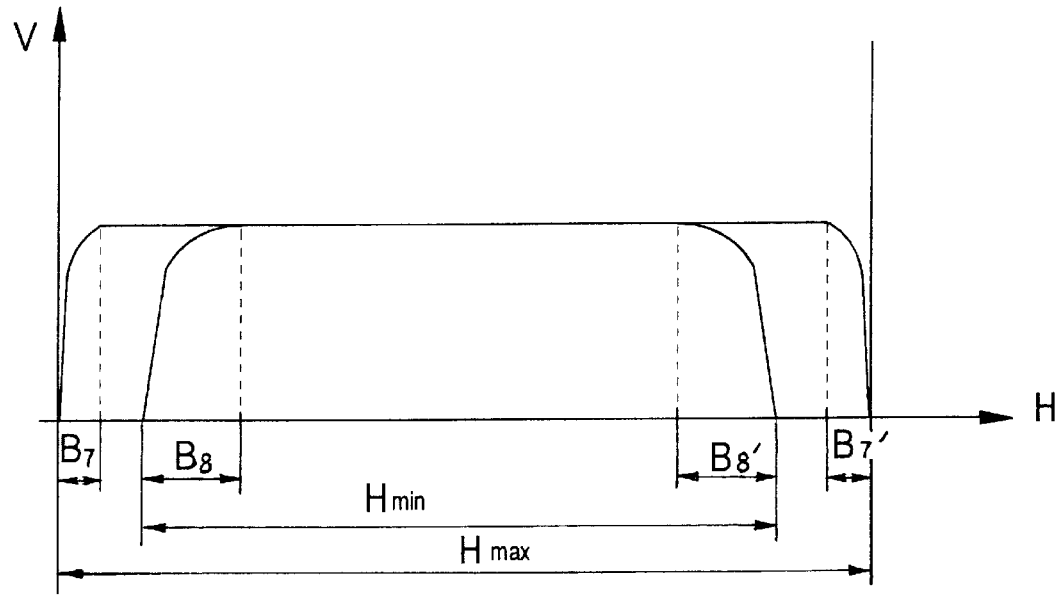
FIG. 6 is a diagram of the yarn guide speed with a stroke modification.

It has shown that the changed yarn deposit as is caused by controlling the acceleration or deceleration is combined preferably with a stroke modification and/or ribbon breaking. To this end, the diagram of FIG. 6 shows the speed function of the yarn guide with a stroke modification and a simultaneously varied reversal length. The yarn guide is controlled alternatingly or by a desired time program between a minimum traverse stroke $H_{min}$ and a maximum traverse stroke $H_{max}$. When traversing the maximum stroke, the yarn guide is accelerated or decelerated within a reversal length $B_7$ and $B_7'$. When traversing the minimum stroke, the yarn guide is accelerated or decelerated within a reversal length $B_8$ and $B_8'$. The reversal lengths $B_8$ and $B_8'$ are greater than the reversal lengths $B_7$ and $B_7'$. To improve the yarn deposit, it is highly preferred to use the combination with the modified method of FIG. 5.

Figure 7:
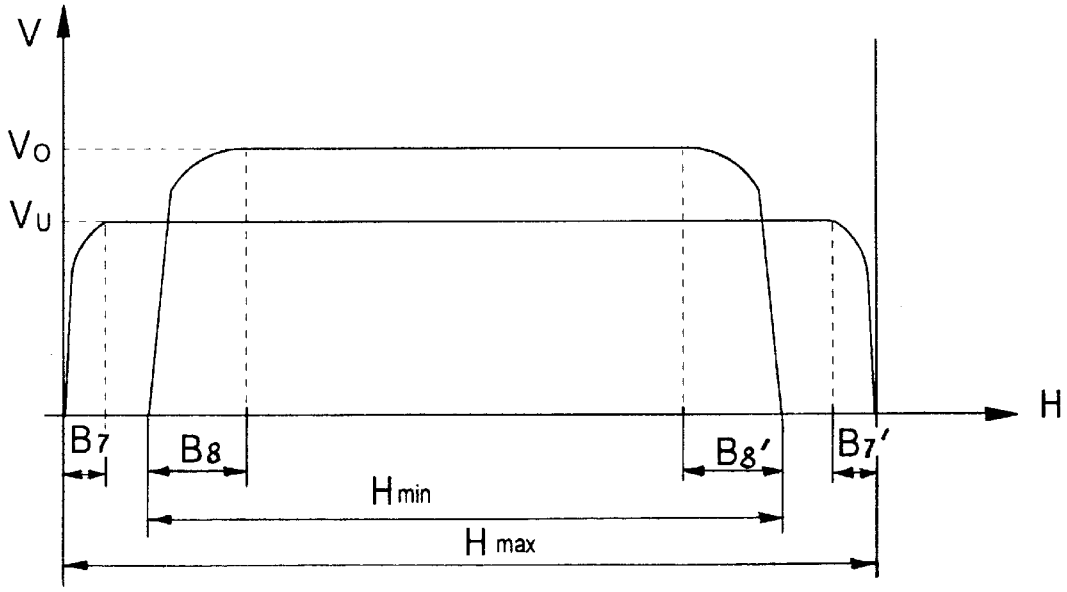
FIG. 7 is a diagram of the yarn guide speed with a stroke modification and a ribbon breaking.

A further modification of the method is shown in FIG. 7. In this instance, the minimum stroke is traversed at a varied guiding speed. The guiding speed of the traversing yarn guide is varied between an upper limit Vo and a lower limit Vu. This speed variation permits substantial compensation for the change in the yarn tension which is caused by the stroke modification. As shown in FIG. 7, the variation of the guiding speed may occur as a function of the traverse stroke. However, it is also possible to control the variation of the guiding speed by a desired time program, for example, a ribbon breaking method.

Figure 8:
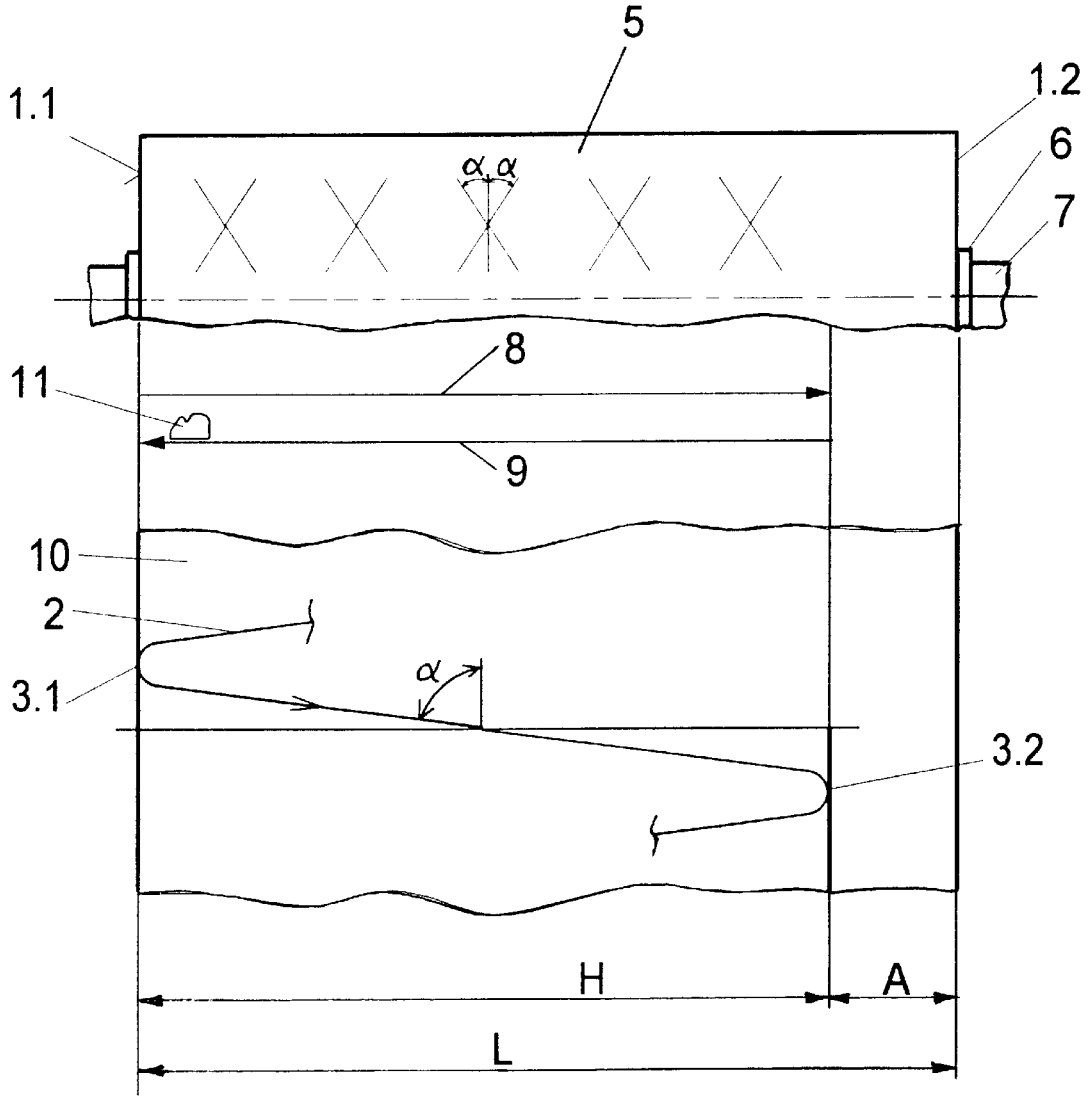
FIG. 8 illustrates a yarn deposit on a package during a traverse stroke with a shortened traverse stroke.

FIG. 8 illustrates a yarn deposit on a package during a traverse stroke. Shown in the upper half of the Figure is a package 5, which is wound on a tube 6. To this end, the tube 6 is inserted on a winding spindle 7. The package 5 is a cylindrical package wound at a constant crossing angle $\alpha$ with end faces 1.1 and 1.2. However, the package 5 may also have a biconical shape or any desired shape. The package 5 may be wound in any desired kind of wind, such as, for example, random wind, precision wind, or stepped precision wind, as well as combinations thereof.

To deposit a yarn on the package, the package 5 is driven by means of a friction roll (not shown) or directly by the winding spindle 7. Shortly before being deposited on the package, the advancing yarn is guided by a yarn guide 11 in direction of movement 8 from the left package end into the region of the right package end, and in direction of movement 9 from the right package end toward the left package end. This sequence of movement is described double stroke of the traversing yarn guide 11. In this instance, the yarn guide traverses the traverse stroke H two times.

However, it is also possible to displace the yarn by means of two yarn guides moving in opposite directions. In this instance, the yarn is displaced up to the reversal point almost at the guiding speed.

It is possible to drive the yarn guide, for example, by a linear drive or by a belt drive.

The lower half of FIG. 8 shows on the package surface 10 a yarn deposit 2 that is made during a traverse stroke. The traverse stroke H is bounded at each end by reversal points 3.1 and 3.2. The reversal point is the position, in which the guided yarn has no speed. Therefore, when reversing the traverse, it is necessary to brake the yarn guide at each end of the traverse stroke, so as to accelerate same again to a guiding speed. Thus, the yarn is often deposited in the region of the traverse stroke ends at a lesser speed, which results in a higher mass distribution on the package. The stroke H that is traversed by the yarn guide 11, is shorter than the wound length L of the package. Within the wound package length L, the traverse stroke H may be displaced such that the reversal point 3.1 of the traverse stroke is flush with the end face 1.1 of package 5. Thus, a spacing forms at the right end of the package between end face 1.2 and reversal point 3.2. This spacing is equal to the modified stroke A. The maximum modified stroke A results from the difference between the wound length L of the package and the traverse stroke H. The displacement of the traverse stroke H within the wound length L of the package 5 may now occur within a modified stroke A. In this instance, it is possible to adjust any desired position, so as to permit adjustment of an optimal mass distribution of the yarn deposited at the ends of the packages.

Figure 9:
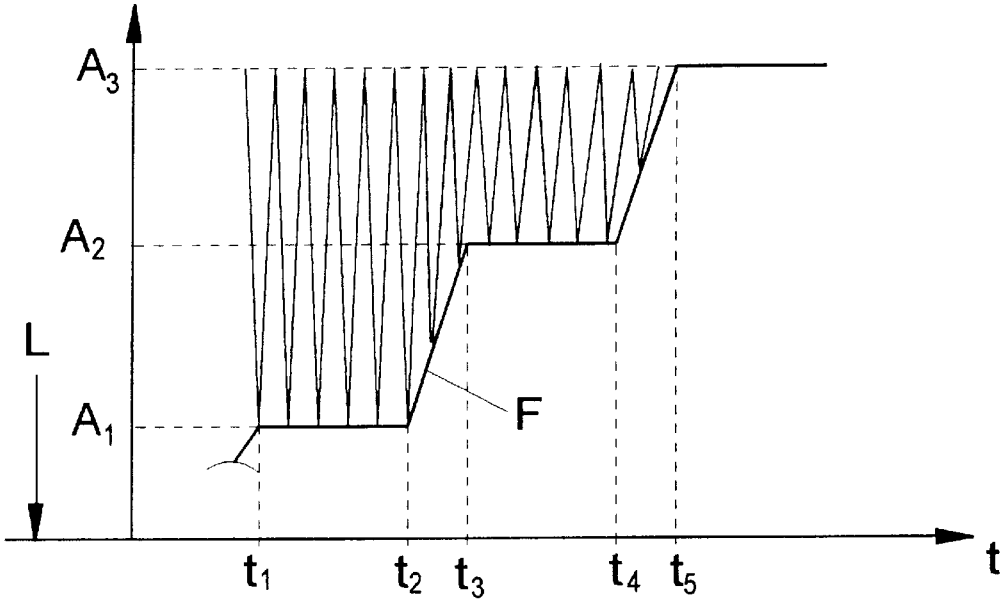
FIG. 9 is time-path diagram of the yarn guide with a one-time displacement of the traverse stroke.

FIG. 9 is a time-path diagram of the yarn guide. The abscissa represents the path, which is covered by the yarn guide at one end of the package. The point of origin is the boundary of the wound package length. The ordinate is shown as the time axis. In the embodiment shown in FIG. 9, the traverse stroke is displaced by a stepped stroke modification function. In the diagram, the stroke modification function is indicated at F. The stroke modification function shows the step sequence of the traverse stroke displacement. Illustrated is a cutout, in which the traverse stroke is relocated from a working point $A_1$ to an adjacent working point $A_2$ and thence to a working point $A_3$. In this instance, while winding the yarn, the yarn guide is guided in working point $A_1$ during the time interval between $t_1$ and $t_2$. In this partial region, the stroke modification function extends parallel to the ordinate. Thus, during the time between $t_1$ and $t_2$, the yarn is deposited in a fixed region on the package surface. Once time $t_2$ is reached, the traverse stroke is suddenly displaced to working point $A_2$. Thereafter, the yarn is again displaced in the time interval between $t_3$ and $t_4$ over a fixed region on the package surface. Once time $t_4$ is reached, the traverse stroke H is relocated relative to the package end in working point $A_3$. These stepped changes in the position of the traverse stroke can be made in both directions until the maximum modified stroke A is reached. This variant of the method has the advantage that stable yarn layers are wound in the respective positions of the traverse stroke.

However, for an even distribution of the packing density of the package surface, it will also be of advantage, when the position change of the traverse stroke proceeds continuously.

Figure 10:
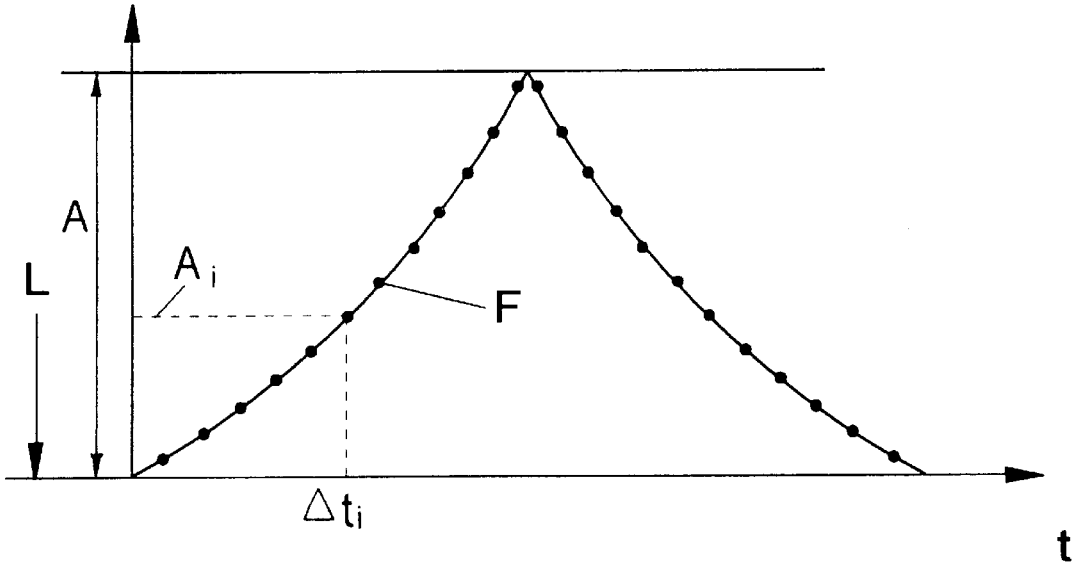
FIG. 10 is a time-path diagram of the yarn guide with several displacements of the traverse stroke within a modified stroke.

FIG. 10 shows a time-path diagram, wherein a stroke modification function F marks the displacement of the traverse stroke into the region of the maximum modified stroke A. The maximum modified stroke is traversed with a step sequence that is defined by the stroke modification function. In this diagram, the package length is again plotted on the abscissa, with the point of origin marking the end of the package. The time is plotted on the ordinate. The stroke modification function F is formed by many individual working points $A_i$. Each working point remains adjusted for a time interval $\delta t_i$. The time interval $\delta t_i$ may be lowered to a value of zero, so that the position of the traverse stroke is changed steadily. As a whole, when traversing the entire modified stroke A, a parabolic pattern results. The transition from one working point to an adjacent working point may be both stepped and continuous, as has been described with reference to FIG. 9. Likewise, the time between two adjacent displacement strokes may be selected such that any desired stroke modification function can be traversed.

In the embodiments of FIGS. 9 and 10, each package end is built up evenly. To produce irregular packages edges, it is necessary to vary the time intervals.

Figure 13:
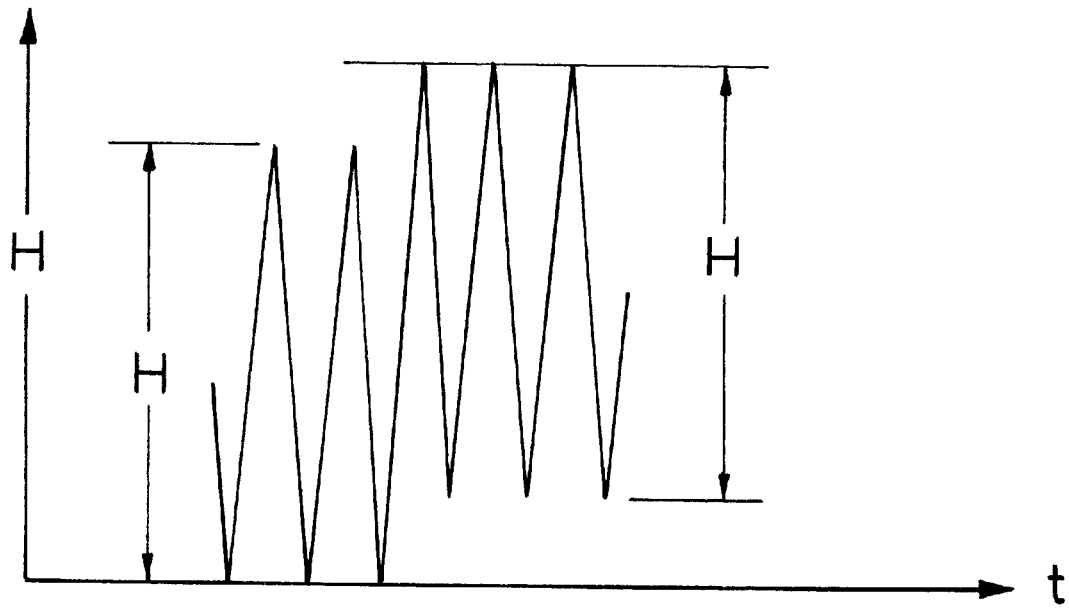
FIG. 13 is a time-path diagram of the yarn guide according to the embodiment of the invention wherein the ends of the traverse stroke are alternately displaced flush with the package ends.

However, there is also the possibility of combining the method with a shortening or lengthening of the traverse stroke, as schematically illustrated in FIG. 13. In this instance, the shortening or lengthening is performed either periodically or after predetermined intervals and for a predetermined period of time. This method permits production of a package, which has different package edges. In particular, it is possible to produce a flattening of one of the package edges for improving the unwinding characteristics.

Since the yarn guide is always reciprocated in the same traverse stroke, and since the traversing speed remains thus unchanged during the displacement of the traverse stroke, it is possible to apply any desired method of breaking the traverse. For example, the traverse speed may be changed between an upper and a lower limit constantly, periodically, or after certain time intervals.

Figure 11:
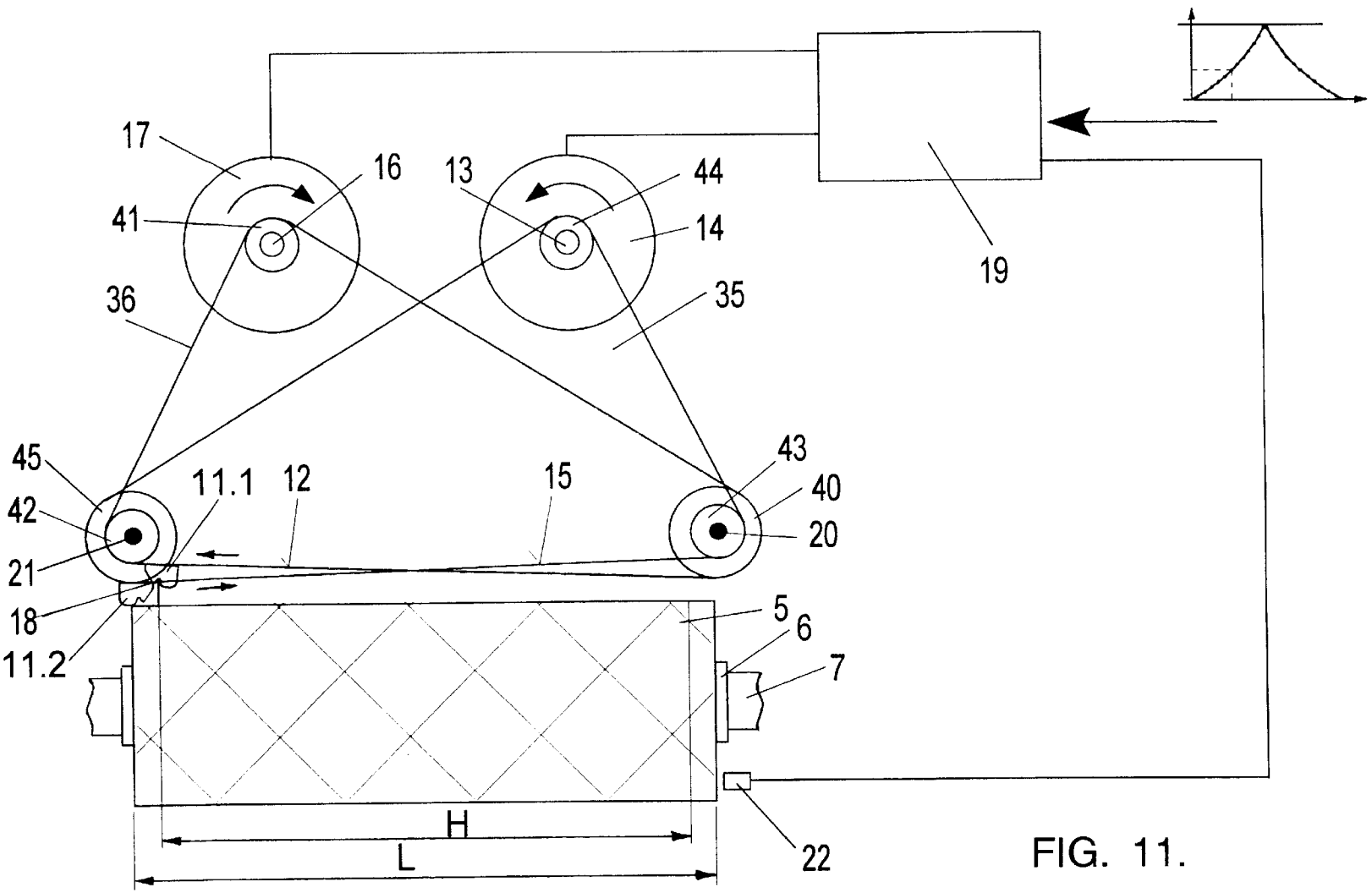
FIG. 11 shows a first embodiment of an apparatus for carrying out the method.

An embodiment of an apparatus for using the method is shown in FIG. 11. In this embodiment, the yarn traversing mechanism consists of a belt drive 35 and a belt drive 36. The belt drive 35 is formed by belt pulleys 43, 44, and 45 and an endless belt 15 that is guided by the belt pulleys. The belt pulley 44 is coupled with a drive shaft 13 of an electric motor 14, and driven in direction of the arrow (counterclockwise). Attached to belt 15 is a yarn guide 11.2. The belt drive 36 consists of belt pulleys 40, 41, and 42 as well as an endless belt 12 that is guided therein. The belt pulley 41 is coupled with a drive shaft 16 of an electric motor 17 and driven in direction of arrow (clockwise). Attached to belt 12 is a yarn guide 11.1. The belt drive 36 is arranged in a plane parallel to belt drive 35, so that the belt pulley 40 of belt drive 36 and the belt pulley 43 of belt drive 35 are coaxial with one another and supported for rotation about an axis 20. Likewise, the belt pulley 42 of belt drive 36 and belt pulley 45 of belt drive 35 are coaxial with each other and supported for rotation about an axis 21. A package 5 to be wound is arranged parallel to belt pulleys 45 and 43 below the belt drives. The package 5 is wound on a tube 6 which is driven via a winding spindle 7.

A yarn 18 which enters in FIG. 11 into the drawing plane substantially vertically, is guided by means of yarn guides 11.1 and 11.2 along a traverse length H. The traverse length H extends only over a partial length of the wound length L of the package. In the illustrated position, the yarn is currently being guided by yarn guide 11.1 toward the left end of the package by means of belt 12. The belt pulley 42 of belt drive 36 has a smaller diameter than coaxial belt pulley 45 of belt drive 35. This causes the yarn guide 11.1 to submerge in part below the yarn guide 11.2 and to thus release the yarn from its guide notch. After the yarn is taken over by yarn guide 11.2 at the end of the traverse stroke, the yarn is guided in opposite direction toward the right end of package 5. Since the belt pulley 43 of belt drive 35 has a smaller diameter than the belt pulley 40 of belt drive 36, the belts cross each other along their run. Therefore, the yarn transfer is repeated at the right end of the package in the same manner as the yarn transfer at the left end of the package.

While the yarn 18 is being guided by yarn guide 11.1 of belt drive 36, the belt drive 36 is driven at a guiding speed that is predetermined by electric motor 17. During this time, the belt drive 36 is driven at an angular velocity, which is predetermined by electric motor 17, so that the yarn guide 11.1 arrives at the end of traverse stroke H at the same time as the yarn guide 11.2. The electric motors 14 and 17 of belt drives 36 and 35 are coupled with each other by means of a control device 19. As a result of the coupling it is possible to predetermine both the guiding speed and the angular velocity of belt drives 35 and 36 in such a manner that the yarn transfer occurs in the reversal point at the stroke end. The control of the guiding speed and the angular velocity permits an alternating displacement of the traverse stroke within the wound length L of the package. Thus, a stroke modification can be realized, so as to influence the edge buildup of the package. Furthermore, the control device is connected to a rotational speed sensor 22, which picks up the rotational speed of winding spindle 7. Thus, it is possible to adjust the traversing speed to any desired amount as a function of the kind of winding.

Figure 12:
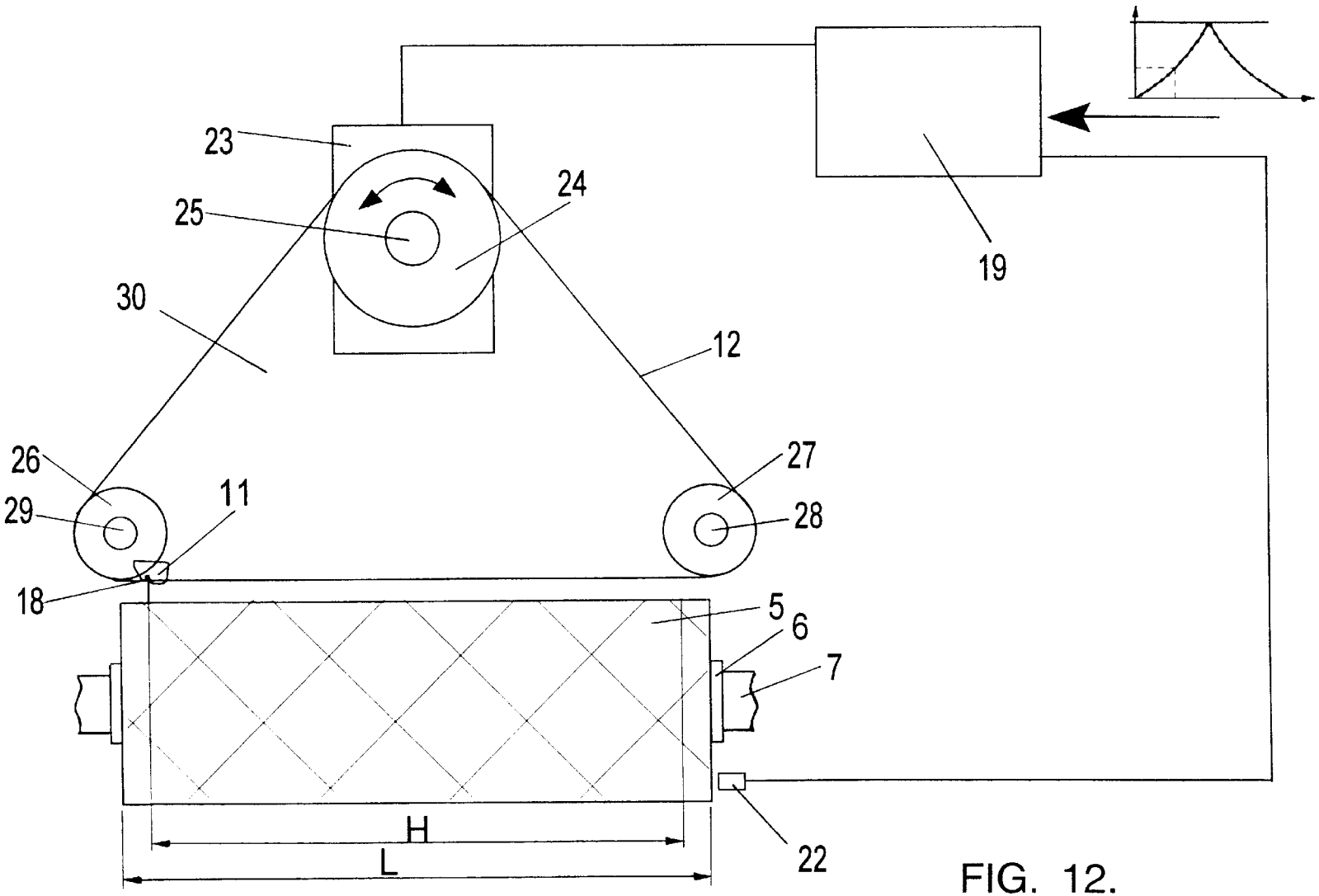
FIG. 12 shows a second embodiment of an apparatus for carrying out the method.

FIG. 12 shows a further embodiment of an apparatus for using the method of the present invention. In this embodiment, the yarn guide 11 is reciprocated by means of a belt drive 30 within a traverse stroke H. The belt drive 30 is formed by belt pulleys 26, 27, and 24. The yarn guide 11 is attached to a belt 12 that loops about belt pulleys 26, 27, and 24, and is reciprocated between belt pulleys 26 and 27. The belt pulley 26 is supported for rotation about an axis 29. The belt pulley 27 is supported for rotation about an axis 28. The belt pulley 24 connects to a drive shaft 25, which is driven in both directions by means of an electric motor 23, for example a stepping motor. The electric motor 23 is activated via a control device 19. Parallel to the belt extending between belt pulleys 26 and 27, a winding spindle is arranged below the belt drive. This winding spindle mounts the tube 6. The package 5 is wound on tube 6. The rotational speed of the winding spindle is picked up by a rotational speed sensor 22 and supplied to the control device 19. It is thus possible to adjust the ratio of traversing speed to circumferential speed of the package. In this arrangement, the movement of yarn guide 11 is positioned by the angular motion of the electric motor. Thus, the control device 19 permits adjustment of any desired change in the traverse stroke H on the package and within the length L.

A winding program as shown in the preceding diagrams may be stored in the control device 19 of FIGS. 11 and 12. The control device 19 will then activate accordingly the electric motor or electric motors as a function of the program sequence. However, it is also possible to realize the displacement apparatus by mechanical devices in a cross-spiralled roll.

In the drawings and specification, there has been set forth a preferred embodiment of the invention, and although specific terms are employed, they are used in a generic and descriptive sense only and not for purposes of limitation.

That which is claimed is:

1. A method of winding a continuously advancing textile yarn into a core supported package, comprising the steps of guiding the advancing yarn onto a rotating core by a traversing yarn guide which moves within a traverse stroke and so that during each traverse stroke the traversing yarn guide is accelerated by a predetermined acceleration to a predetermined guiding speed within a reversal length at one end of the traverse stroke, decelerated from the predetermined guiding speed by a predetermined deceleration within a second reversal length at the opposite end of the traverse stroke, and maintained at said predetermined guiding speed along a linear length extending between said reversal lengths, and changing at least one of the acceleration and the deceleration of the yarn guide during at least some of the traverse strokes so as to change the extent of the associated reversal lengths and so that the deposit of the yarn onto the package is varied at least one of the package ends.

2. Method as in claim 1, wherein the changing of one of the acceleration and deceleration of the yarn guide occurs in accordance with a reversal function that is predetermined by a microprocessor.

3. Method as in claim 2, wherein the reversal function is symmetric.

4. Method as in claim 2, wherein the reversal function is asymmetric.

5. Method as in claim 1, wherein the changing of one of the deceleration and the acceleration of the yarn guide occurs in accordance with a predetermined time program.

6. Method as in claim 1, wherein the changing of one of the acceleration and the deceleration of the yarn guide occurs as a function of the guiding speed.

7. Method as in claim 6, comprising the further step of periodically increasing the guiding speed to avoid ribbons while maintaining the acceleration and deceleration constant so that the extent of the reversal lengths becomes greater.

8. Method as in claim 6, comprising the further step of periodically decreasing the guiding speed to avoid ribbons while maintaining the acceleration and deceleration constant in such a manner that the extent of the reversal lengths becomes smaller.

9. Method as in claim 1, wherein the guiding speed is lower or higher before reversing the movement of the yarn guide than after reversing the movement of the yarn guide.

10. Method as in claim 1, wherein the guiding speed of the yarn guide is changed from one predetermined guiding speed within a traverse stroke to a different predetermined guiding speed within a different traverse stroke.

11. Method as in claim 1, wherein the controlling of one of the acceleration and the deceleration of the yarn guide occurs as a function of the traverse stroke length.

12. Method as in claim 11, comprising the further step of periodically decreasing the traverse stroke length while controlling the acceleration and deceleration such that the extent of the reversal lengths becomes greater.

13. Method as in claim 11, comprising the further step of periodically increasing the traverse stroke length while controlling the acceleration and deceleration such that the extent of the reversal lengths becomes smaller.

14. Method as in claim 1, wherein the deposit of the yarn onto the package defines a wound length of the package, wherein the traverse strokes have a constant length which is smaller than the wound length of the package, and wherein the ends of the traverse strokes are alternatingly displaced flush with the package ends.

15. Method as in claim 14, wherein in the region of the package ends, the ends of the traverse stroke are each displaced within a maximum modified stroke, which equals the difference between the wound length of the package and the length of the traverse stroke.

16. Method as in claim 15, wherein the displacement of the traverse stroke is controlled in such a manner that the change in position of the traverse stroke occurs as a function of a stroke modification function that predetermines a step sequence.

17. Method as in claim 16, characterized in that the stroke modification function predetermines a chronological correlation between two adjacent positions of the traverse stroke.

18. Method as in claim 16, characterized in that the stroke modification function predetermines a chronological correlation between the position changes of the traverse stroke and the maximum modified stroke.

19. Method as in claim 14, wherein the displacement of the traverse stroke occurs by a predetermined time program.

20. Method as in claim 1, wherein the deposit of the yarn onto the package defines a wound length of the package, wherein the lengths of the traverse strokes are alternately shortened and lengthened, and wherein the ends of the traverse strokes are alternately displaced between the package ends.

21. A method of winding a continuously advancing textile yarn into a core supported package, comprising the steps of guiding the advancing yarn onto a rotating core by a traversing yarn guide which moves within a traverse stroke and so that during each traverse stroke the traversing yarn guide is accelerated by a predetermined acceleration to a predetermined guiding speed within a reversal length at one end of the traverse stroke, decelerated from the predetermined guiding speed by a predetermined deceleration within a second reversal length at the opposite end of the traverse stroke, and maintained at said predetermined guiding speed along a linear length extending between said reversal lengths, and changing the acceleration and the deceleration of the yarn guide during at least some of the traverse strokes so as to change the extent of associated reversal lengths and so that the deposit of the yarn onto the package is separately varied at each of the package ends.

* * * * *